United States Patent [19]

Chakravarti

[11] 4,317,271

[45] Mar. 2, 1982

[54] METHOD OF MAKING METAL TUBES

[75] Inventor: Bhaven Chakravarti, Hixson, Tenn.

[73] Assignee: Combustion Engineering, Inc., Windsor, Conn.

[21] Appl. No.: 105,178

[22] Filed: Dec. 19, 1979

[51] Int. Cl.[3] ..... B22D 11/126

[52] U.S. Cl. ..... 29/527.6; 164/114; 164/286; 164/298; 29/526.2; 29/526.4; 29/526.5

[58] Field of Search ..... 29/527.6, 526.2, 526.4.526.5, 29/526.6, 527.7; 164/114, 115, 116, 117, 286, 298, 291

[56] References Cited

U.S. PATENT DOCUMENTS

| | | | |
|---|---|---|---|
| 35,884 | 7/1862 | Millholland | 164/291 |
| 1,987,201 | 1/1935 | McAllister | 29/527.6 |
| 2,002,415 | 5/1935 | Otto | 29/527.7 |
| 2,461,765 | 2/1949 | Olt | 29/149.5 PM |
| 2,659,107 | 11/1953 | Bell | 164/116 X |
| 2,991,541 | 7/1961 | Gieren | 29/527.6 X |
| 3,259,975 | 7/1966 | Chapman | 29/527.7 |

FOREIGN PATENT DOCUMENTS

| | | | |
|---|---|---|---|
| 558498 | 6/1958 | Canada | 164/114 |
| 846774 | 8/1952 | Fed. Rep. of Germany | 164/286 |
| 767722 | 4/1953 | Fed. Rep. of Germany | 164/286 |
| 974177 | 9/1950 | France | 164/114 |
| 974178 | 9/1950 | France | 164/114 |
| 421844 | 6/1947 | Italy | 164/114 |
| 50-33021 | 10/1975 | Japan | 164/114 |

*Primary Examiner*—Francis S. Husar
*Assistant Examiner*—V. K. Rising
*Attorney, Agent, or Firm*—Robert L. Olson

[57] ABSTRACT

A method and apparatus for making metal tubes (12) by centrifugally casting muffs (12) in a rotating mold (10), the inner diameter of which is tapered, having a smaller diameter at the pouring end (14) and a larger diameter at the non-pouring end. The outer diameter of the resulting muff is then machined (30) to form a cylindrical member of uniform diameter along its entire length. The inner diameter is also machined (28) smooth, and the finished muff is then reduced (32,34) in diameter and wall thickness to make a long tube (12).

2 Claims, 4 Drawing Figures

METHOD OF MAKING METAL TUBES

BACKGROUND OF THE INVENTION

One method of making metal tubes, especially high alloy tubes, is to centrifugally cast a cylindrical muff, and then reduce the muff in diameter and wall thickness to form a tube. Since considerable impurities or defects are trapped in the metal of the muff near both the inner and outer surfaces during the centrifugal casting, both the inner and outer surfaces are machined to remove these defects prior to the reducing action. Some of these impurities or defects run fairly deep into the wall thickness, and thus much machining is necessary to remove the defective material. One band of impurities or defects generally starts at the outer surface of the muff, about midway along its length, and progressively goes deeper, extending towards the non-pouring end of the muff or casting.

SUMMARY OF THE INVENTION

The method and apparatus of the invention is for making metal tubes by centrifugally casting a muff in a mold which is tapered outwardly from the pouring end to the non-pouring end, so that the casting or muff has a larger diameter at the non-pouring end. The muff is then machined, both along its inner and outer surfaces to form a cylinder of even diameter along its entire length. The machining removes any defects and impurities from the muff. The finished muff may be reduced in diameter and wall thickness, forming a tube, or used as cast.

DESCRIPTION OF THE PREFERRED EMBODIMENT

Figure 1:
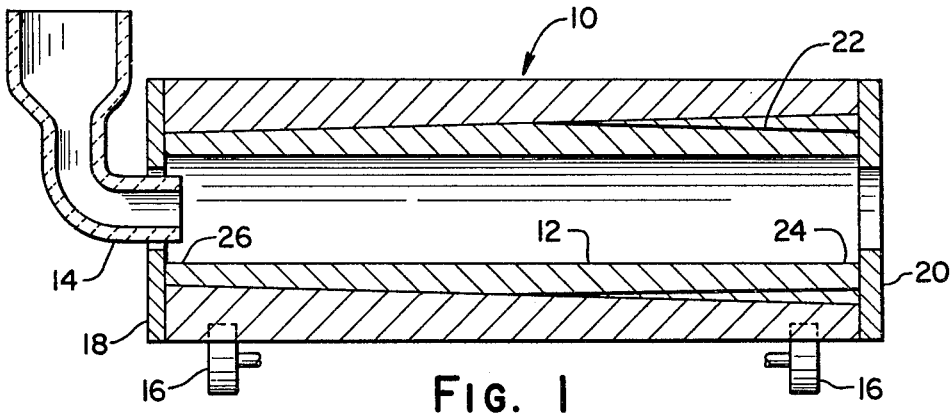
FIG. 1 is a schematic showing of a centrifugal casting process.

Looking now to FIG. 1 10 represents a centrifugal casting mold in which metal muffs 12 are made. In casting the muffs 12, a predetermined amount of molten metal, determined by the dimensions of the muff to be cast, is poured at a preselected rate through the nozzle 14 into the rapidly rotating mold 10 which is rotated by two pairs of driven rollers 16. The metal mold 10 is lined with a refractory material which permits easy withdrawal of the finished casting. End pieces 18 and 20 prevent the molten metal from escaping out the ends of the mold during the casting operation.

As shown by a dark line 22 starting at about the midpoint of the casting 12 near the OD surface and running deeper into the casting as the band moves towards the non-pouring end, there is a band of impurities or defective material. For this reason, as will be explained in more detail later, the mold is tapered having a larger ID at the non-pouring end and a smaller ID at the pouring end. Thus, the casting or muff 12 is thicker at end 24 and tapers down to a thinner wall at end 26.

Figure 2:
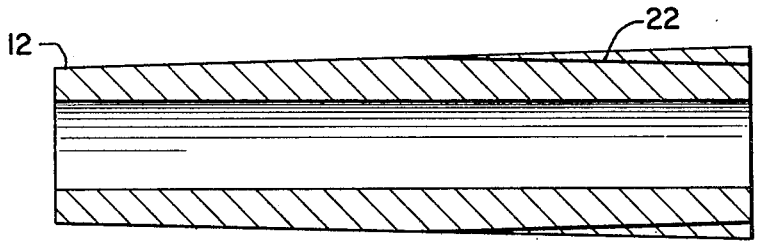
FIG. 2 is a sectional view of the casting or muff.

The casting is allowed to cool, and then is removed from the mold 10 by taking end piece 20 off, and removing the casting through this end of the mold. FIG. 2 shows the tapered casting or muff 12 containing the band of impurities or defective material 22.

Figure 3:
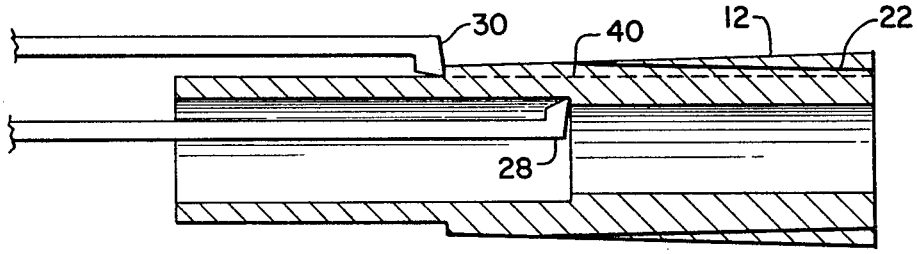
FIG. 3 is a sectional schematic view of the finishing or machining operation.
Figure 4:
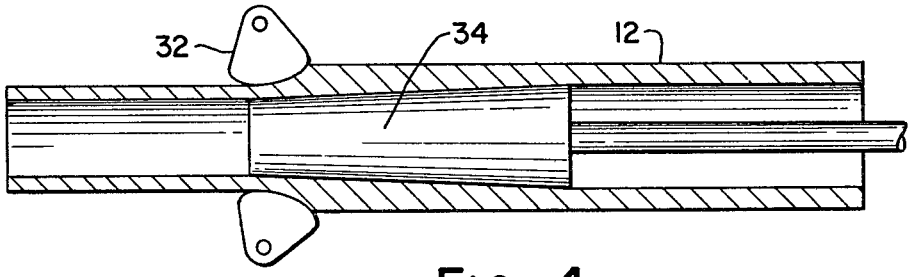
FIG. 4 is a sectional schematic view showing the rolling steps reducing the muff in wall thickness and diameter.

The muff is next machined (FIG. 3) by any suitable cutting tools 28 and 30 on both its inner and outer surfaces, to remove impurities which tend to migrate and congregate near the surfaces during the casting and cooling operation. The outer diameter is machined such that the finished muff has a constant diameter along its entire length. This is indicated by dashed line 40. Such machining removes the entire band of impurities 22. Depending on the amount of metal cut from the ID and OD, the machining may, and most likely will, be accomplished by a number of cuts, rather than in a single pass. Either the tool or the muff can be rotated and moved longitudinally during the machining step. After the muff has been machined, it is reduced in wall thickness and diameter (FIG. 4). Depending on the alloy, the wall thickness can be reduced up to 70 or 80 percent in a single pass by squeezing it between rolls or rockers 32 and over a mandrel 34. This operation greatly lengthens the tube reducing both the OD and ID and the wall thickness. As many passes can be made of the tube through the machine as required to get the desired tube size.

I claim:

1. The method of making metal tubes including the steps of centrifugally casting a hollow metal muff by pouring molten metal into one end of a rotating mold, the inner diameter of which mold is tapered, with the smaller diameter being at the pouring end, the muff having a band of impurities extending from a point about midway between the ends, to the non-pouring end, the band starting midway between the ends at the outer surface, and running deeper as it moves towards the non-pouring end, removing the muff from the mold, machining the inner and outer surfaces of the muff so that it has an even inner and outer diameter throughout its entire length, sufficient material being removed from the outer surface such that substantially all of the band of impurities is removed.

2. The method set forth in claim 1, including the further step of reducing the muff in diameter and wall thickness, to form a longer metal tube.

* * * * *